United States Patent [19]

Ellen

[11] 4,108,583

[45] Aug. 22, 1978

[54] VERTICALLY MOVING SLIP FORMS

[75] Inventor: Peter Edington Ellen, Turramurra, Australia

[73] Assignee: Elspan International Limited, Causeway Bay, Hong Kong

[21] Appl. No.: 747,869

[22] Filed: Dec. 6, 1976

[51] Int. Cl.[2] ..... E04G 11/22

[52] U.S. Cl. ..... 425/65; 249/22

[58] Field of Search ..... 264/33, 34; 249/20–22; 425/63–65

[56] References Cited

U.S. PATENT DOCUMENTS

| | | | |
|---|---|---|---|
| 2,705,359 | 4/1955 | Strandberg | 264/33 |
| 3,275,719 | 9/1966 | Dudson | 264/33 |

FOREIGN PATENT DOCUMENTS

| | | | |
|---|---|---|---|
| 2,451,134 | 6/1976 | Fed. Rep. of Germany | 425/63 |
| 276,373 | 5/1970 | U.S.S.R. | 425/63 |

*Primary Examiner*—Francis S. Husar
*Assistant Examiner*—John McQuade

[57] ABSTRACT

As a means of casting concrete floors in concrete and other structures the invention provides a type of formwork in which a platform is supported from vertical elements of the structure, the platform having vertically extending housing means depending from its under side which are associated hinged formwork members. The arrangement is such that the formwork may be set up so that one or more concrete floors of a building may be cast, the hinged formwork members being arranged in a horizontal position so as to form a support for the floor or floors. After casting and setting of the concrete the hinged formwork members are folded into the housing so that the platform may be raised vertically drawing the housing and formwork members through apertures left in the cast floors. The floors are completed by filling the apertures with concrete.

1 Claim, 10 Drawing Figures

VERTICALLY MOVING SLIP FORMS

The present invention relates to formwork for use in casting the floors of concrete structures. The invention is applicable to concrete bearing-wall type structures and also to concrete structures having steel or concrete columns.

The invention consists in formwork comprising a platform adapted to be supported from vertical elements of a structure and being associated with means whereby it may be raised in relation thereto, the platform having a plurality of hollow vertically extending housing means depending from its underside, there being associated with each housing means at, at least, one and up to five levels spaced apart vertically at distances corresponding to a storey height of the structure, at least one formwork member hingedly attached to the housing means and being arranged to be hinged from a vertical position in which it lies within the periphery of the housing means to a horizontal position in which it can be attached to and supported by an adjacent housing means, the arrangement being such that when all said formwork members are in a horizontal position, either with or without the use of additional horizontal forms, concrete floors can be cast at each level and thereafter the forms hinged downwardly to the said vertical position to permit the platform to be raised by said raising means drawing with it the vertically extending housing means and formwork members contained therein through holes left in the concrete floors during the casting procedure.

Figure 1:
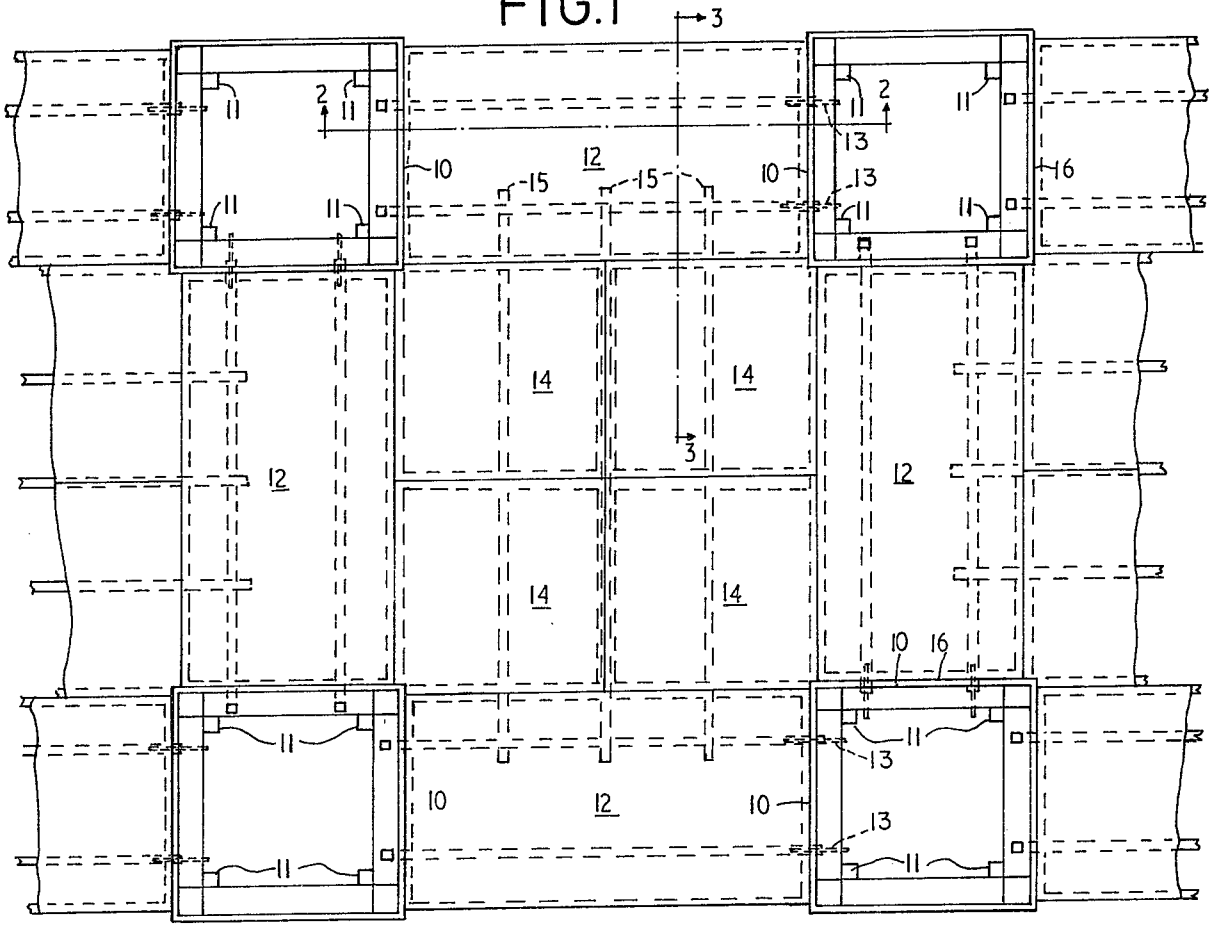
Figure 2:
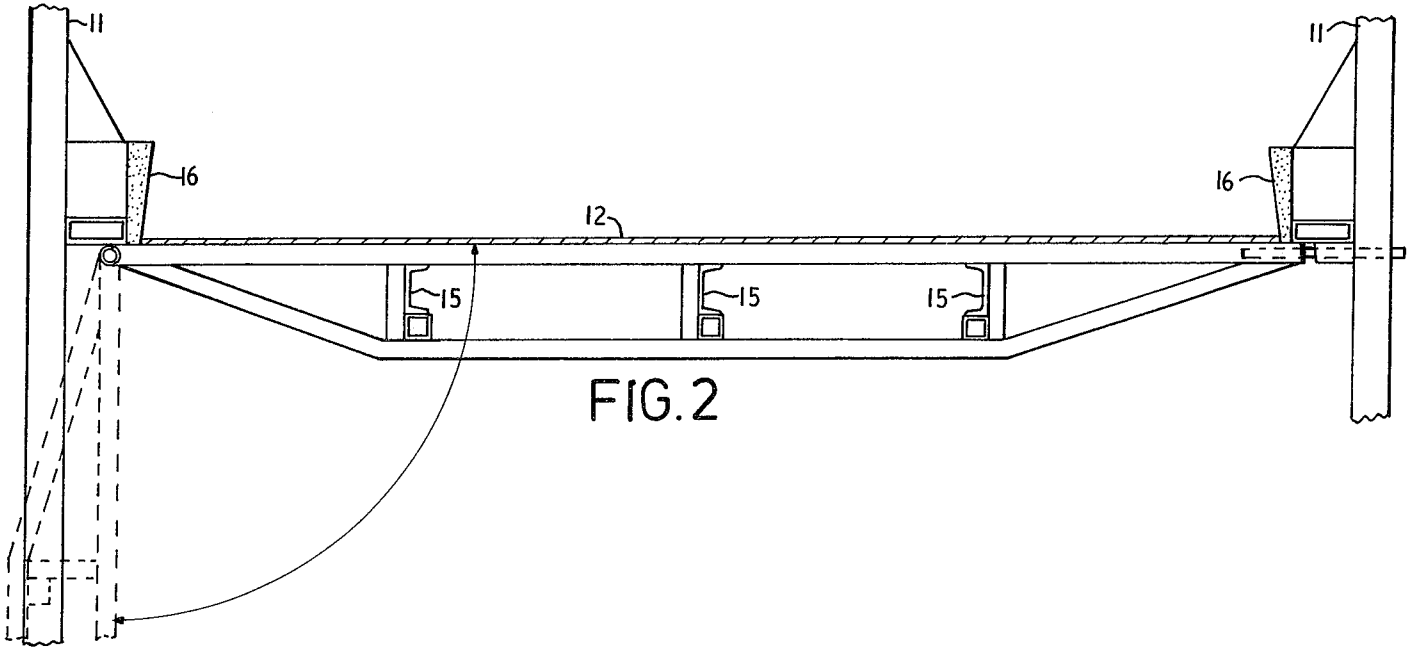
Figure 3:
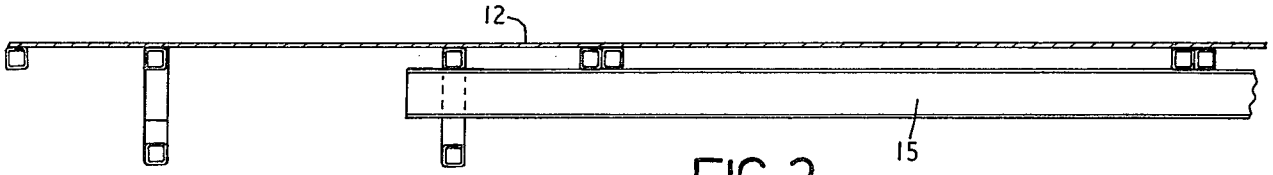
Figure 8:
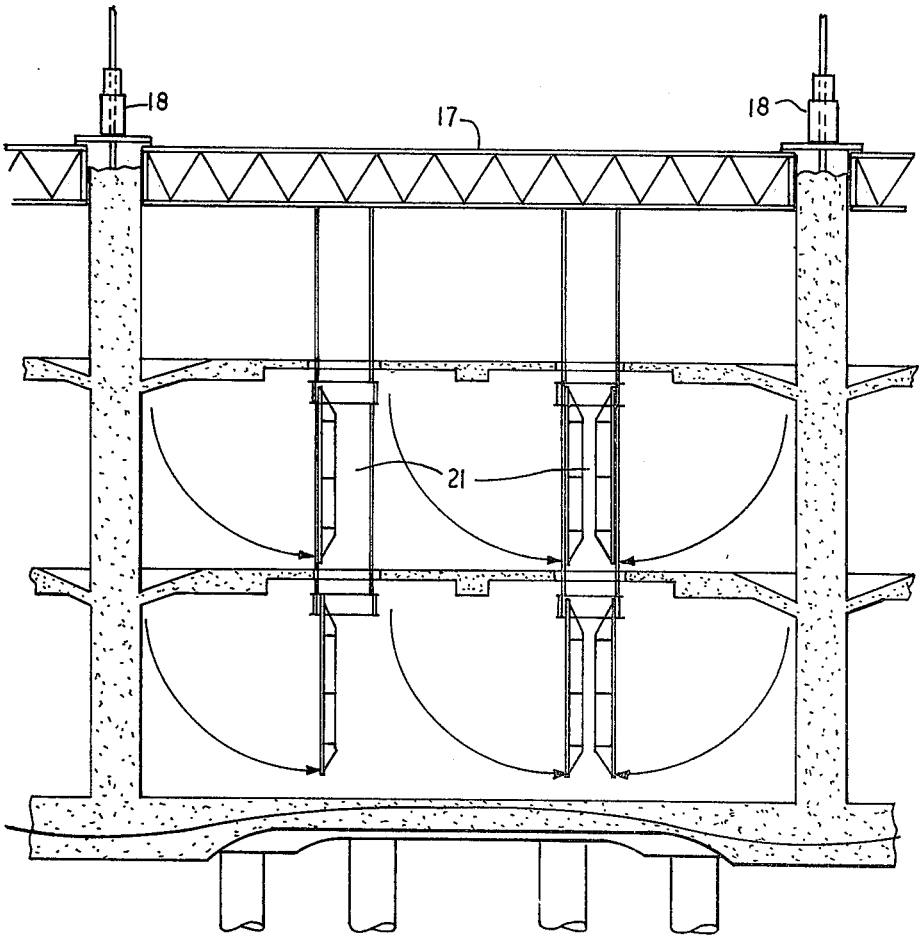
Figure 9:
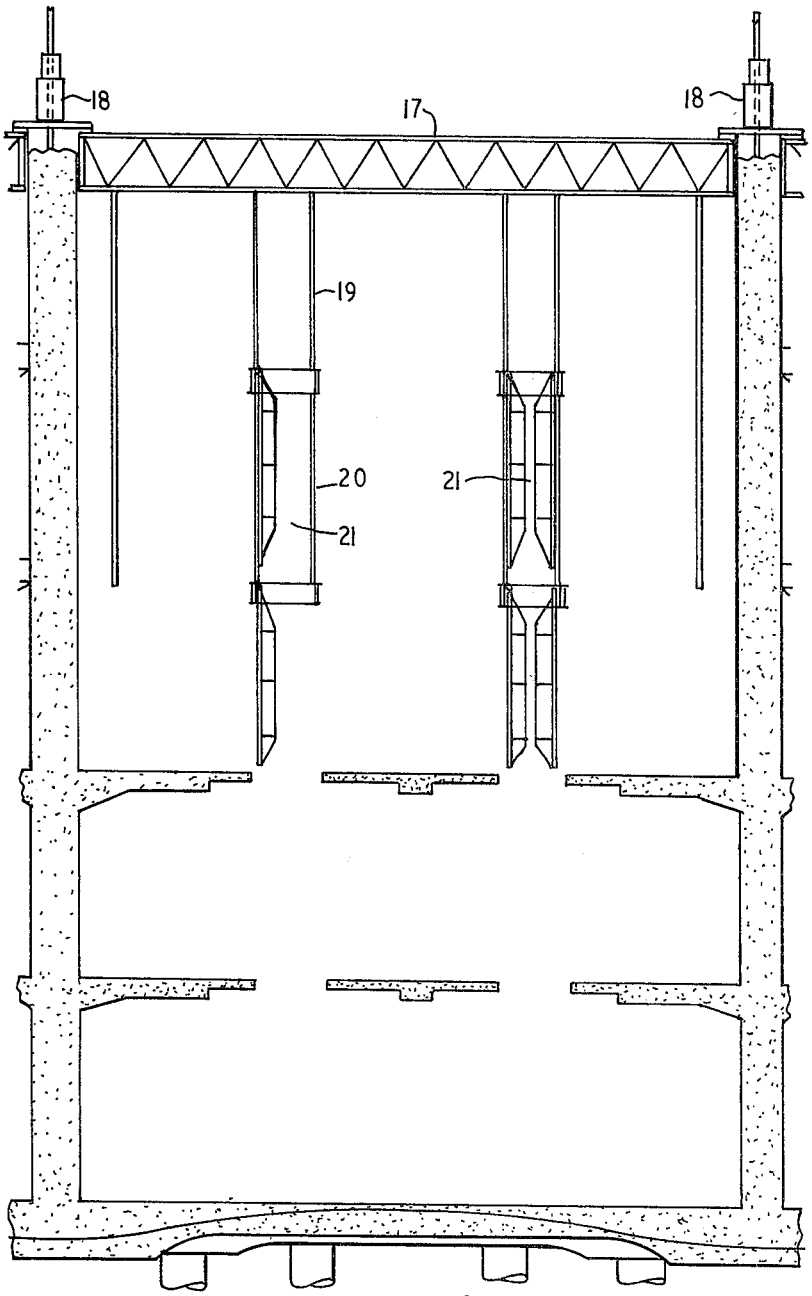
Figure 10:
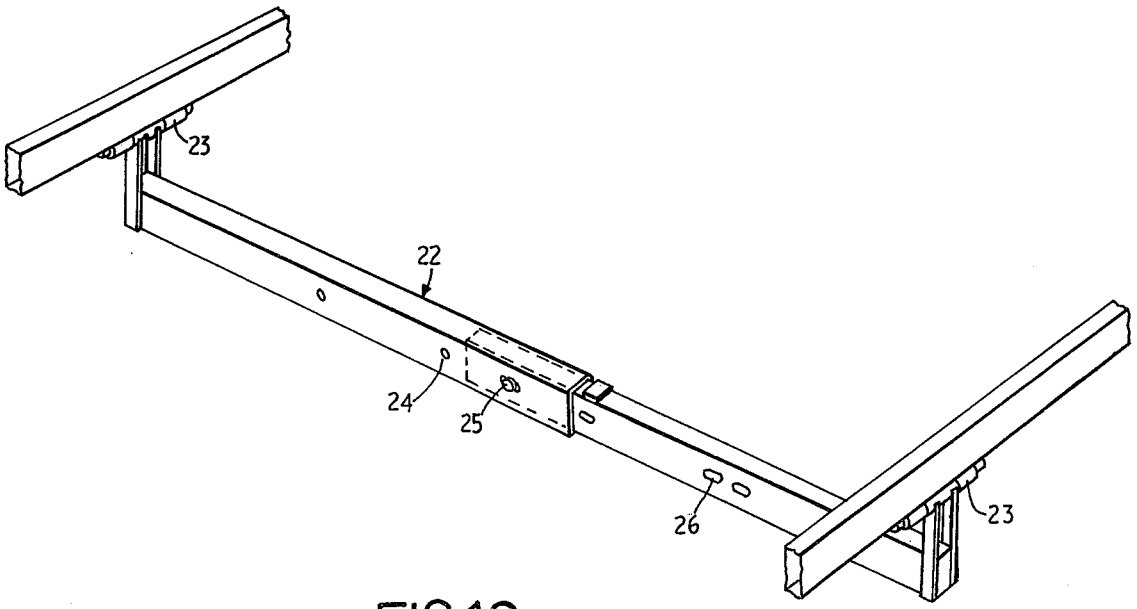

In order that the invention may be better understood and put into practice a preferred form thereof is hereinafter described by way of example with reference to the accompanying drawings in which:

FIG. 1 is a plan view of a typical portion of formwork according to the invention, FIG. 2 is a section on 2—2 of FIG. 1, FIG. 3 is a section on 3—3 of FIG. 1, FIGS. 4 to 9 are views in elevation of a building in the course of construction utilising formwork according to the invention at different stages, and FIG. 10 is a perspective view of an adjustable beam that can be used as part of the formwork.

FIG. 1 shows a plan view of a typical level of the formwork. Above the plane of the paper is conventional wall slip formwork supporting a platform which spans between the slip forms. Depending from the platform are four rectangular section vertical housings 10 each constituted by four vertical hangers 11. Each housing 10 has hingedly attached to it at least one folding form, such as 12, which may either be folded to a vertical position as shown in FIG. 2 in broken lines or be arranged in a horizontal position as shown in FIG. 1, in which position it is supported on the adjacent vertical housing 10 by means of the pins 13, which may be extended or retracted at will.

As can be seen from the figures the forms 12 produce a level surface over a proportion of the area of the floor to be cast. The central area between the housings 10 is filled by means of separate formwork panels 14 supported on bearers 15 thus providing a flat casting surface over the whole area with the exception of the area occupied by the housings 10.

After casting a floor the bearers 15 and pannels 14 are removed and placed within the housings 10. The pins 13 are then retracted and the forms 12 folded down to the vertical position. In this position they are contained within the area of the housings 10 as defined by the styrene or timber boxed edge forms 16. If the slip form platform is now raised the housings 10 are raised with it taking with them all the formwork necessary for casting a floor. The holes left in the floors for the passage of the housings can be readily filled at a later date in a conventional manner.

It is estimated that a conventional slip form platform is strong enough to support formwork for casting up to five floors of a building.

The procedure for constructing a building using the formwork of the invention is as follows.

The building foundations are completed in the usual manner and in the application of the invention to a concrete bearing wall type structure the following steps are taken.

Figure 4:
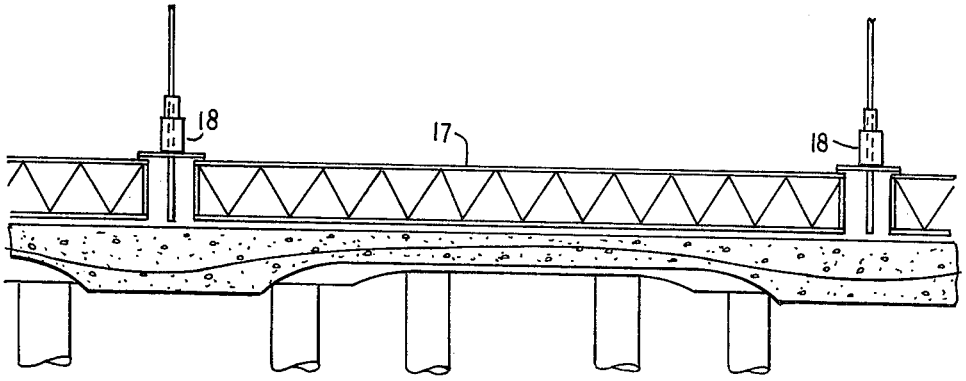

(a) Wall slip formwork is erected together with the major platform 17 spanning between the slip forms, as is conventional in slip form practice (FIG. 4).

(b) Hydraulic jacks 18 operating on steel jacking rods in a conventional manner are so located as to carry the weight of this platform and the hanging structure (FIG. 4).

(c) The first level of the wall slip form is completed raising the platform 17 one storey height. (FIG. 4).

Figure 5:
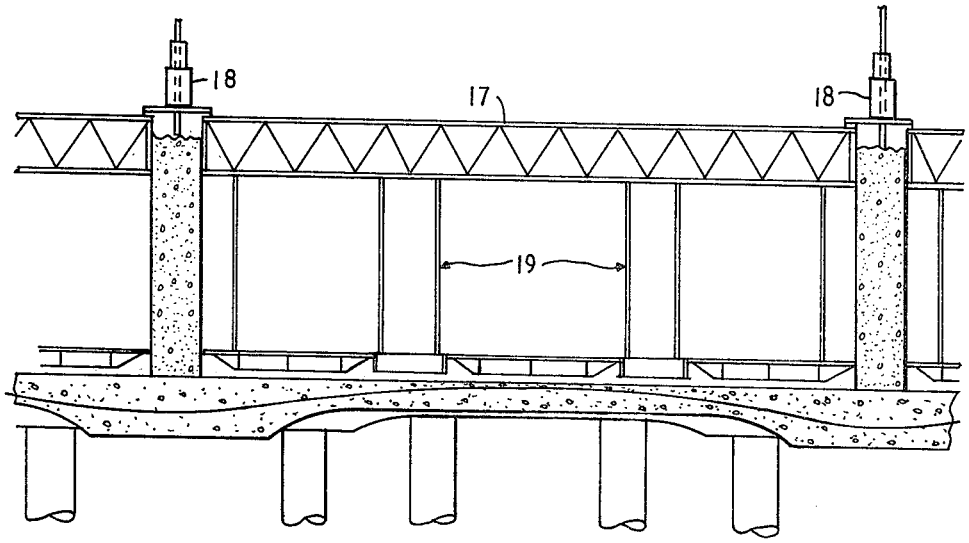

(d) The first level of the hanging formwork 19 is assembled on the building foundations and attached to the main slip form platform 17. (FIG. 5).

Figure 6:
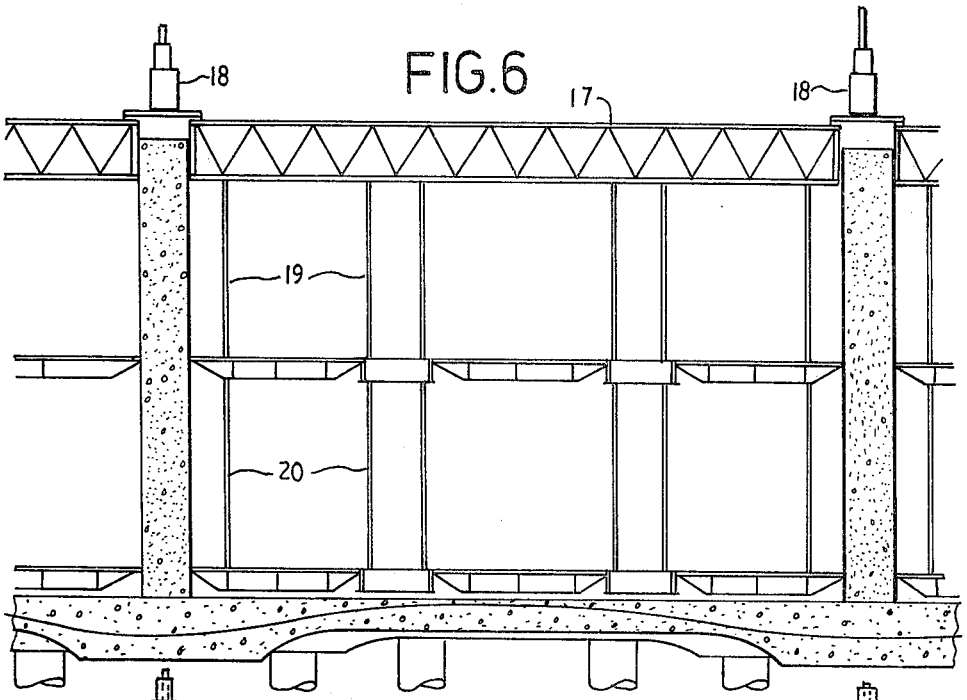

(e) The slip form is raised a further storey height and a further hanging platform 20 is added, this process being repeated until the desired number of hanging platforms are attached. (FIG. 6).

(f) Post-tensioning cables (not shown) are then threaded through the slip formed walls in such a profile as to support the structural floors spanning between the walls. To provide adequate levels of prestressing other cables may be laid to conform to the design requirements of the floors.

Figure 7:
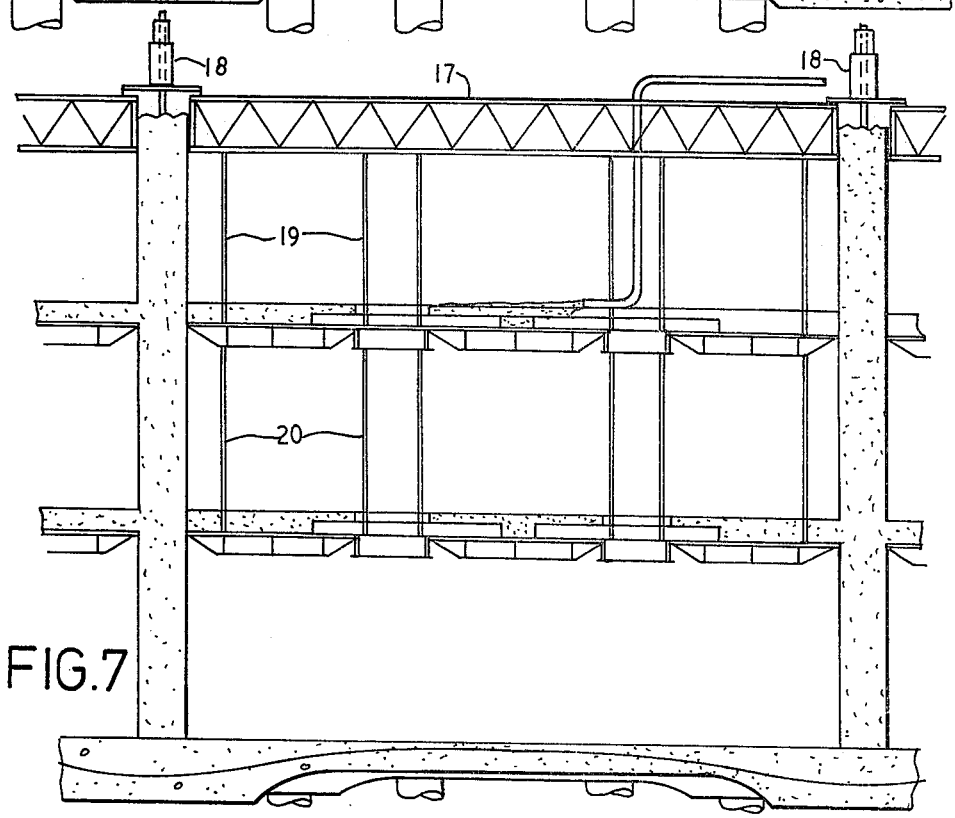

(g) The floors are then concreted. (FIG. 7).

(h) The following day or later the cables (not shown) are post-tensioned by hydraulic jacks and grouted to ensure complete bond to the structure.

(i) The hanging formwork 19 and 20 is then released to fold down and to be contained within the vertical housings 21 depending from the platform. The structure is now free to slide upward through holes cast in each floor. (FIG. 8).

(j) The slip form process is recommenced and proceeds until the number of storey heights equals the number of hanging platforms. (FIG. 9).

(k) On arrival at this level the hanging platforms are opened out and joined together to form a complete formwork deck for each particular floor and the process is repeated until all floors have been cast.

The procedure described above is applicable to concrete bearing wall type structures but with minor modifications is equally applicable to concrete structures having steel or concrete columns.

FIG. 10 shows a beam 22 that is telescopically adjustable as to length that may be used as part of the formwork. After setting the length of the beam by telescoping one half into the other a pin 25 is passed through the coinciding hole 24 and slot 26. Each end of the beam is hinged at 23.

The use of formwork according to the invention enables the formwork to be moved vertically up the structure in contrast to the conventional process in which the formwork is moved horizontally from underneath the completed floors and lifted to the new position above the last floor cast. It also eliminates all propping and structural support from the floors below as the vertical housings transfer the weight of freshly placed concrete directly through the slip form platform to the bearing walls and/or columns.

The embodiment of the invention described above is given by way of example only as constituting a preferred form of the invention defined in the succeeding claims.

I claim:

1. A formwork system comprising a platform adapted to be supported from vertical elements of a structure and being associated with raising means whereby it may be raised in relation to said vertical elements, the platform having a plurality of hollow vertically extending housing means depending from its underside, there being associated with each housing means at least one and up to five vertically spaced horizontal formwork members, the spacing being at distances corresponding to a storey height of the structure, each formwork member being hingedly attached to a housing means and being adapted to be moved from a vertical position in which it lies within the periphery of a corresponding housing means to which it is attached, to a horizontal position in which it can be attached to and supported by an adjacent housing means, said system being so arranged that when all said formwork members are in a horizontal position, concrete floors can be cast at each level and thereafter said formwork members may be directed downwardly to the said vertical position to permit the platform to be raised by said raising means, thereby drawing with it the vertically extending housing means and formwork members contained therein through holes left in the concrete floors during casting of the concrete floors.

* * * * *